US005188091A

United States Patent [19]

Gardner

[11] Patent Number: 5,188,091

[45] Date of Patent: Feb. 23, 1993

[54] FIREPLACE ENCLOSURE

[76] Inventor: Maxwell Gardner, 34 New England Dr., Wallingford, Conn. 06492

[21] Appl. No.: 834,420

[22] Filed: Feb. 12, 1992

[51] Int. Cl.[5] ..... F24B 1/192

[52] U.S. Cl. ..... 126/548; 126/551; 126/201; 160/229.1

[58] Field of Search ..... 126/544, 547, 548, 551, 126/201; 160/135, 229.1

[56] References Cited

U.S. PATENT DOCUMENTS

| | | | |
|---|---|---|---|
| D. 286,322 | 10/1986 | Catania et al. . | |
| D. 288,712 | 3/1987 | Catania et al. . | |
| 1,554,334 | 9/1925 | Cranshaw et al. | 160/229.1 |
| 1,588,529 | 6/1926 | Cranshaw | 160/229.1 |
| 1,635,573 | 7/1927 | Bertram | 160/229.1 |
| 2,294,046 | 8/1942 | Cser . | |
| 3,995,612 | 12/1976 | Dew | 126/547 |
| 4,027,649 | 6/1977 | Jackson . | |
| 4,048,979 | 9/1977 | LaVasseur . | |
| 4,154,217 | 5/1979 | Buckner . | |
| 4,174,700 | 11/1979 | Bartsch . | |
| 4,236,499 | 12/1980 | Simeone . | |
| 4,256,084 | 3/1981 | Engleman . | |
| 4,294,224 | 10/1981 | Luther, Sr. . | |
| 4,512,330 | 4/1985 | Larkins | 126/547 |
| 4,971,032 | 11/1990 | Gardner . | |

FOREIGN PATENT DOCUMENTS

| | | | |
|---|---|---|---|
| 537353 | 2/1957 | Canada | 126/544 |
| 22324 | of 1900 | United Kingdom . | |
| 5057 | of 1911 | United Kingdom . | |
| 178541 | 4/1922 | United Kingdom . | |
| 268083 | 3/1927 | United Kingdom . | |

OTHER PUBLICATIONS

Best Products Catalog 1980/81-p. 299, Fireplace Screen K.

"Fireplace Ideas" brochure, p. 11-Screen #44, 1988.

*Primary Examiner*—Carroll B. Dority

*Attorney, Agent, or Firm*—Caesar, Rivise, Bernstein, Cohen & Pokotilow, Ltd.

[57] ABSTRACT

A fireplace enclosure comprising a plurality of glass panels and a plurality of screen panels, with the screen panels being positioned exteriorly of the glass panels. The glass panels are maintained within a frame which is integrally connected to the screen panels. At least one of the screen panels is pivotable to an open position, which permits access to the glass doors, and into the fireplace. The glass doors are also movable relative to the frame, to permit access to the fireplace. A latching mechanism maintains the screen panels in a closed position, which prevents ready access to the fireplace. A removable arch plate is releasably secured to the interior of the frame for the glass panels, and provides a decorative arch, which is seen through the glass panels.

22 Claims, 5 Drawing Sheets

FIG. 6
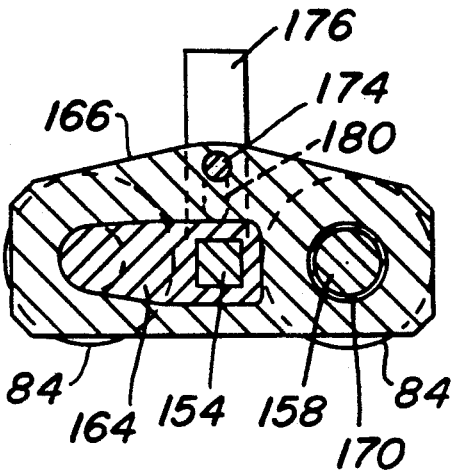
FIG. 4
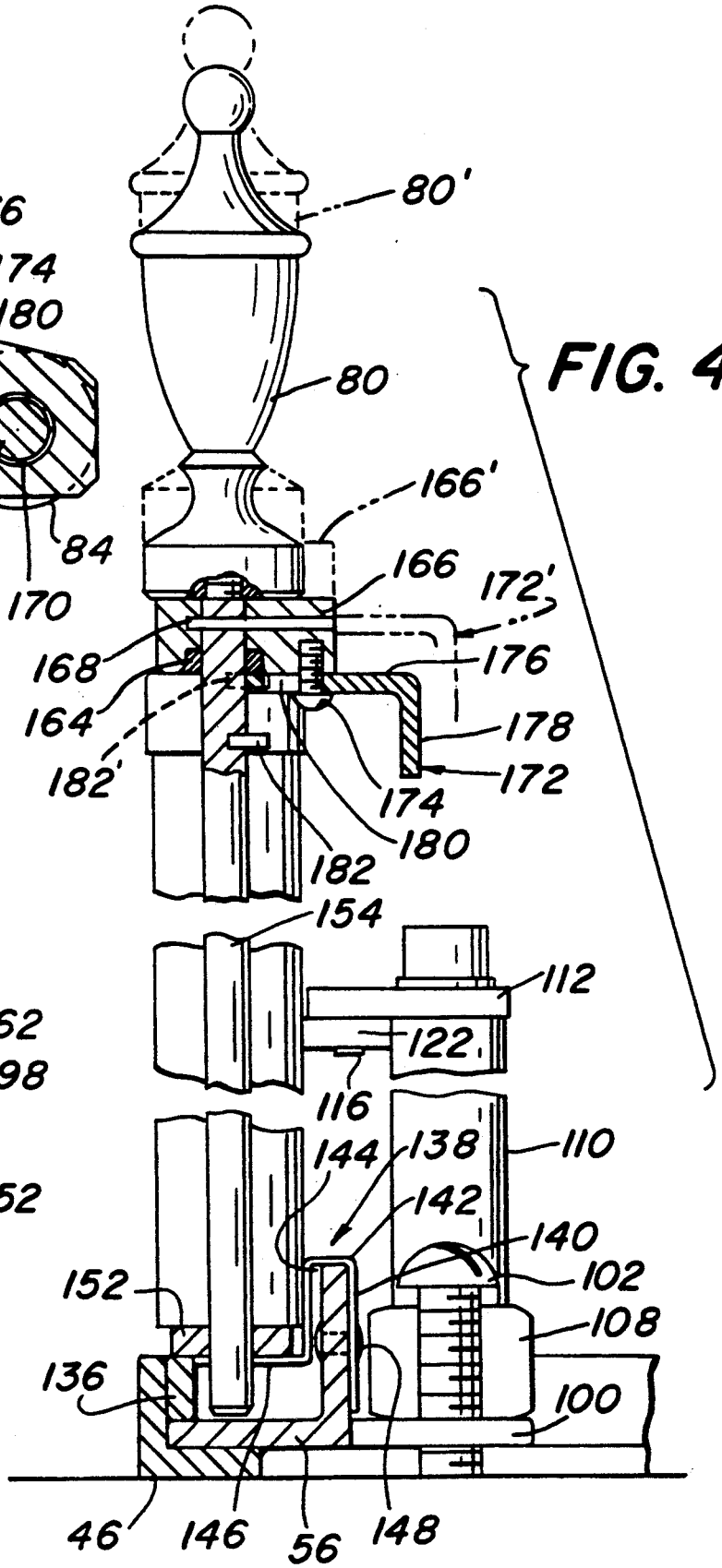
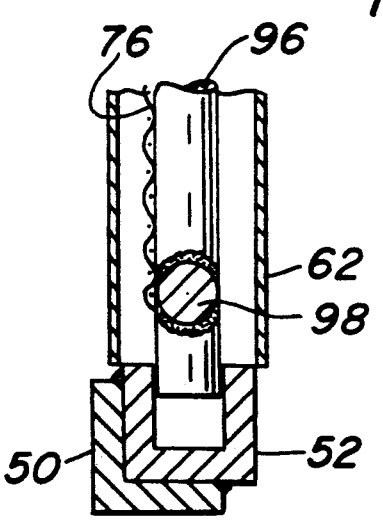
FIG. 9

FIREPLACE ENCLOSURE

BACKGROUND OF THE INVENTION

This invention relates to a fireplace enclosure, in general, and, more particularly, to an assembly that includes glass doors with a screen placed in front of the doors, with both the doors and screen covering the fireplace opening.

During the operation of a fireplace, hot gases rising from the fire will draw large amounts of heated air out of a room, and discharge the heated air up the chimney of the fireplace. Normally, during the active combustion of wood in a fireplace, the loss of heated air from the room is generally compensated by the heat convected and radiated out of the fireplace by the burning wood, and into the room. Accordingly, during active combustion, there tends not to be any great heat loss caused by the fire, and, for aesthetic reasons, it is preferred to leave the fireplace open rather than sealing the fireplace with glass doors.

After the fire has completely died out, it is common to close the damper of the fireplace chimney in order to prevent the loss of heat from the room up the chimney. However, it is not possible to close the damper until the fire has completely died out. Thus, during the period between active combustion and the fire's being completely extinguished, there is a period of time where the damper must remain open and substantial heat loss occurs from the room up the chimney. In addition to unwanted heat loss up the chimney, there is also the substantial danger of a down draft, which might result in forcing ashes out of the fireplace and into the room.

In order to obviate the problem of heat loss up the chimney, when a fire has died down, but is not totally extinguished, various mechanisms have been developed for sealing the fireplace opening. The most popular of these mechanisms is glass doors, which are mounted in the fireplace opening. The doors are pivotable in a frame mounted in the opening, and they can be opened during active combustion of the fire. However, when the glass doors are open, it is necessary that a screen be provided to prevent any of the ashes from flying out of the fire and into the room. The screen is generally mounted interiorly of the glass doors, and is suspended from a traverse rod. The screen can be opened, in the nature of a drapery, in order to place wood in the fireplace and light the fire, and can be closed when the fire is in active combustion. After the fire has died down, in order to prevent heat loss up the chimney, the glass doors are closed.

An alternative to the use of permanently installed glass doors is disclosed in Applicant's prior U.S. Pat. No. 4,971,032. In that patent, a foldable shield is disclosed, which is removable during active combustion of the fire. A free-standing fireplace screen is placed in front of the active fire, and when the active fire has died out, the shield is placed over the opening, and held in place by the frame of the free-standing screen.

The free-standing screens are placed on the hearth, in front of the fire, and serve the function of preventing any ashes from flying into the room. The screens usually have three or four panels, which are hinged together to permit them to be folded into a flat condition and removed so that the fireplace can be filled with wood and the fire ignited. Thereafter, the screen is returned to its position in front of the active fire. Designs for the free-standing screens, in both the three and four panel configurations, are shown in prior U.S. Pat. Nos. Des. 286,322 and Des. 288,712. Applicant is a co-inventor in both of these patents.

One of the problems with the permanent glass doors, which are now in common usage, is that the screen curtain behind the glass doors presents a hazard for young children. If they should be in the room and inadvertently fall against the screen curtain, they will not be prevented from falling into the fire. Although it is possible to have free-standing screens in front of the glass doors, to prevent the hazard of a child's falling into the fire, the free-standing screens must be physically removed and folded in order to place wood in the fireplace and start the fire.

One of the features of this invention is that a combination of glass doors and a screen in front of the glass doors is provided. However, rather than having the screen as a free-standing screen, it is mounted in place in front of the glass doors, and it has doors which are pivotably openable. This provides all of the advantages of the glass doors and the free-standing screen, without the disadvantage of having to remove the screen and fold it, during the placement of wood in the fireplace and the starting of the fire.

In another aspect of this invention, a safety latch is provided to maintain the screen in its closed position, thereby preventing a small child from getting close to the fire. The screen cannot be pivoted from its closed position, unless the latch is released. The latch is positioned in such a way that a small child will be unable to reach it, or if the child could reach it, the child would not have sufficient dexterity to open the latch.

In yet another aspect of this invention, a removable arch insert is provided to give the frame surrounding the fireplace doors an arcuate appearance at the top. Presently, whenever an arch shape is desired for the frame on fireplace doors, the arch is formed as an integral part of the frame. This can prove to be quite costly, since the glass in the fireplace doors must be cut with an arcuate upper edge, rather than using rectangular pieces of glass of standard dimensions. Various shapes can be provided for the arch insert, and the inserts can easily be changed. This permits the owner of the fireplace enclosure to vary the appearance of the enclosure, at minimal cost.

OBJECTS OF THE INVENTION

Accordingly, it is a general object of this invention to provide a novel fireplace enclosure.

It is another object of this invention to provide a fireplace enclosure consisting of glass doors and a fireplace screen rigidly supported exteriorly of the glass doors.

It is a further object of this invention to provide a fireplace screen supported in a fixed position in front of a fireplace, with at least one pivotable panel in the central portion thereof.

It is yet another object of this invention to provide a fireplace enclosure with a removable arch mounted in the frame thereof.

SUMMARY OF THE INVENTION

These and other objects of the invention are accomplished by providing a fireplace enclosure comprising a plurality of glass panels and a plurality of screen panels, with the screen panels being positioned exteriorly of the glass panels. The glass panels are maintained within a frame which is integrally connected to the screen panels. At least one of the screen panels is pivotable to an open position, which permits access to the glass doors, and into the fireplace. The glass doors are also movable relative to the frame, to permit access to the fireplace. A latching mechanism maintains the screen panels in a closed position, which prevents ready access to the fireplace.

DESCRIPTION OF THE DRAWINGS

Other objects and many of the attendant advantages of this invention will become readily appreciated as the same becomes better understood by reference to the following detailed description, when considered in connection with the accompanying drawings, wherein:

FIG. 4 is a sectional view taken along the line 4—4 of FIG. 3;

FIG. 6 is a sectional view taken along the line 6—6 of FIG. 3;

FIG. 9 is an enlarged sectional view taken along the line 9—9 of FIG. 2;

DETAILED DESCRIPTION OF THE PREFERRED EMBODIMENT

Figure 1:
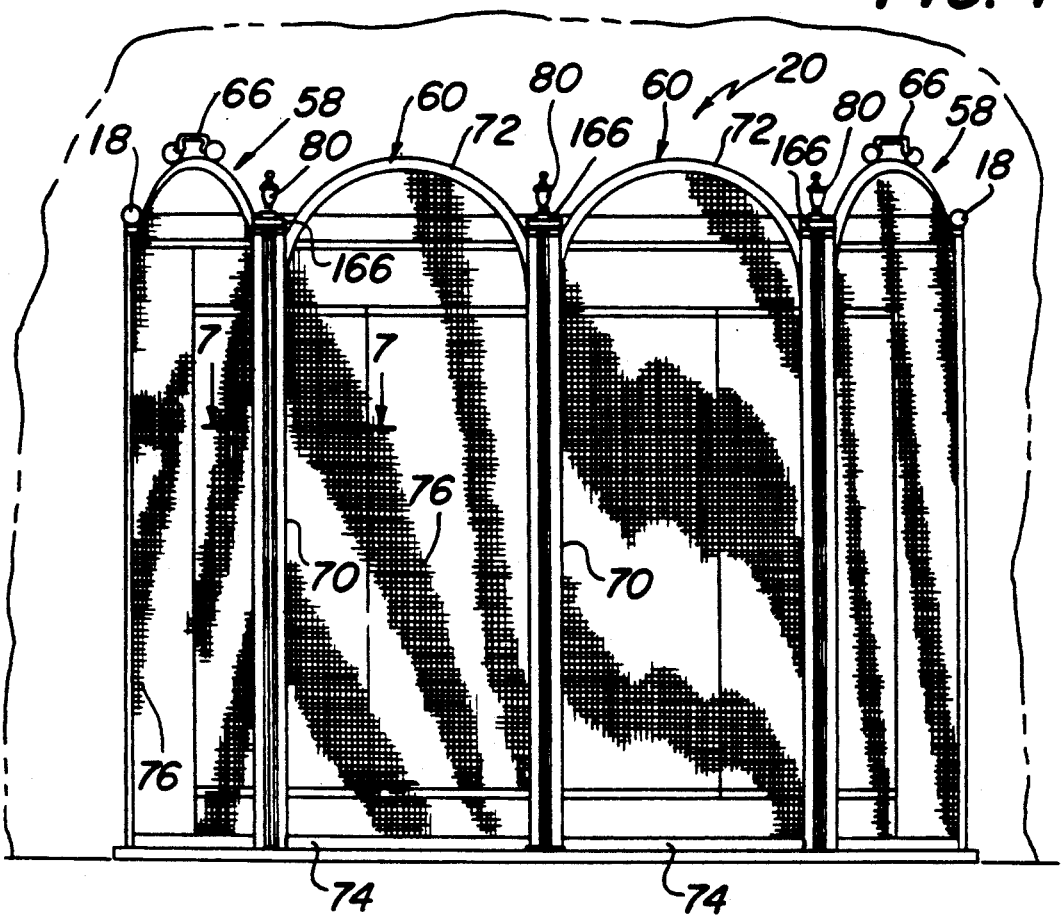
FIG. 1 is a front elevational view of the fireplace enclosure of this invention, in its closed condition.
Figure 2:
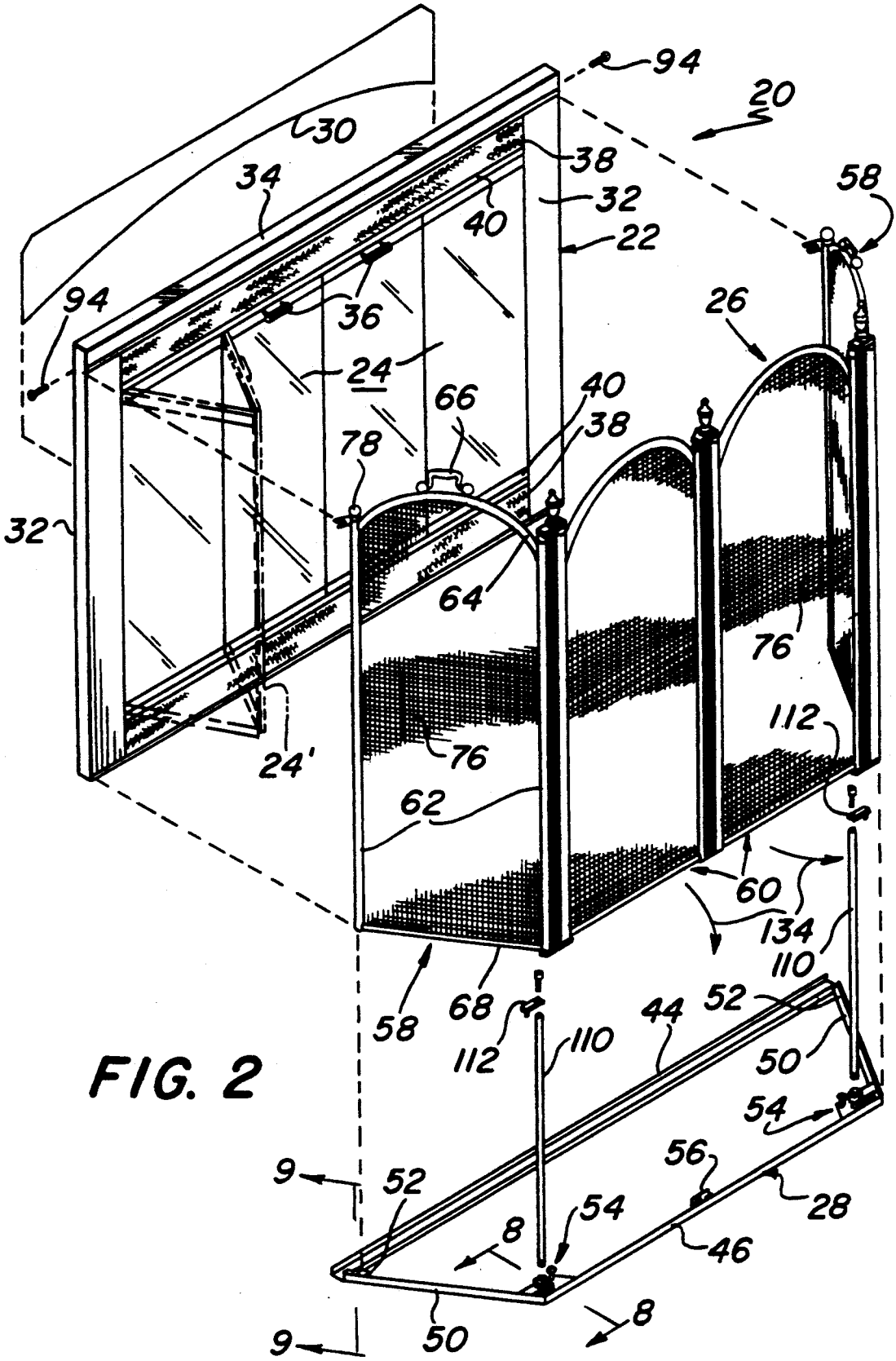
FIG. 2 is an exploded perspective view showing the elements of the fireplace enclosure.

Referring now in greater detail to the various figures of the drawings, wherein like reference characters refer to like parts, a fireplace enclosure embodying the present invention is generally shown at 20 in FIG. 1. As seen in FIG. 2, enclosure 20 basically comprises a frame 22, having a plurality of glass doors or panels 24, a screen assembly 26, a support frame 28 and an arch 30.

Frame 22 is a conventional frame used for fireplace doors, and includes vertical legs 32 and a top member 34. The legs and top member are hollow, and can be formed from a decorative metal, such as brass. The outer glass panels 24 are pivotally secured to legs 32, and the inner glass panels 24 are hinged to their adjacent outer panels. Handles 36 are mounted on the tops of inner panels 24.

The glass doors 24 are aligned, as shown in full line in FIG. 2, when the opening to the fireplace is to be closed. The doors are maintained in the aligned position by any conventional means, such as spring clips or magnetic plates. When it is desired to gain access to the fireplace, such as when filling the fireplace and igniting the fire, or when the fire is in active combustion, the doors 24 are pivoted around their respective hinges, as indicated at 24' in FIG. 2. The opening and closing of the doors is conventional in the art, as is the general structure of the enclosure containing the doors.

With the doors in their aligned position, closing the fireplace, the fire can still burn. In order to enable sufficient air to enter the fireplace, to support combustion, metal grills 38 are provided at the top and bottom of frame 22. The grills have openings, through which air from the room passes. Frame 22 includes bars 40 positioned at the bottom of the top grill 38 and at the top of the bottom grill 38.

Figure 11:
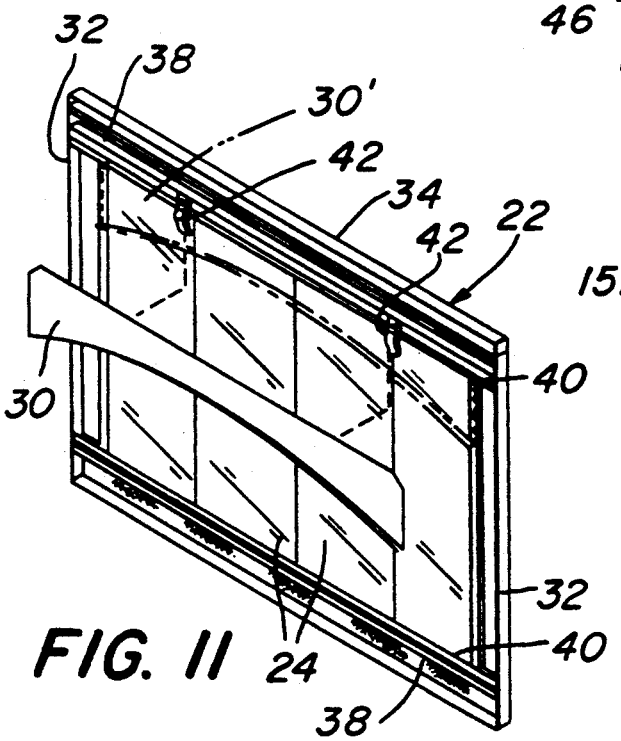

Referring to FIG. it is seen that a pair of spring clips 42 is secured to the inner surface of upper bar 40. When it is desired to have an arch in the upper surface of the door frame, arch plate 30 is slid between the spring clips 42 and the upper bar 40, as indicated at 30' in FIG. 11. The arch 30 is formed from a flat sheet of metal, which can be the same metal as the door frame. Thus, if the door frame is formed from brass, the arch plate 30 can also be formed from brass, to give a unitary appearance to the frame. With the frame 22 in place, the arch plate 30 can easily be slid into place from the exterior of the fireplace, when the doors 24 are open. The plate 30 can be formed in any desired shape, and can inexpensively provide an arch at the top of the frame, without the necessity of designing a custom-shaped frame. The arch is always visible through the glass doors 24.

The glass doors can be formed from any heat-resistant glass, as is conventional in the art. Tempered safety glass is preferred. The handles 36 facilitate the opening and closing of the glass doors.

Referring again to FIG. 2, it is seen that support frame 28 is in the shape of a trapezoid, and includes a rear leg 44, a front leg 46 that is parallel to rear leg 44, and side legs 50. Legs 44, 46 and 50 lie in a horizontal plane. Rear leg 44 is U-shaped, and open at the top, and legs 46 and 50 are L-shaped (see also FIG. 7). Small U-shaped channels 52 are mounted on legs 50, adjacent rear leg 44 (see also FIG. 9). Mounting assemblies 54 are secured at the intersections of legs 46 and 50 (see also FIG. 7). Mounted in the center of leg 46 is a small L-shaped bracket 56 (see also FIG. 4).

In assembling the enclosure of this invention, the frame 28 is placed on the hearth in front of the fireplace. Frame 22 is then inserted in U-shaped leg 44 of frame 28. The frame 22 can be dimensioned to fit within the fireplace opening, or to be slightly greater than the fireplace opening, so that it can be mounted against the face of the wall adjacent the opening. The frame 22 is then secured in place, utilizing any conventional method of securement for frames used with fireplaces, such as bolting the frame in place.

The screen 26 is supported on frame 28, and is secured to frame 22. The screen comprises a pair of side panels 58 and a pair of center panels 60. Each side panel includes a pair of vertical tubular members 62 and an arcuate tubular member 64 connecting the two members 62. A decorative handle 66 is secured to the top of each arcuate member 64. A horizontal tubular member 68 connects the bottoms of members 62.

Center screen panels 60 are similar in structure, size and appearance to end panels 58. The center panels include vertical tubular members 70, arcuate tubular member 72 and a lower horizontal tubular member 74. A wire screen 76 is mounted in each set of tubular members. Decorative balls 78 are secured on the tops of the outermost tubular members 68 and finials 80 are positioned between adjacent pairs of panels 58 and 60. The tubular members, decorative balls and finials of the screen panels are preferably formed from a decorative metal, such as brass or chrome-plated steel.

Figure 10:
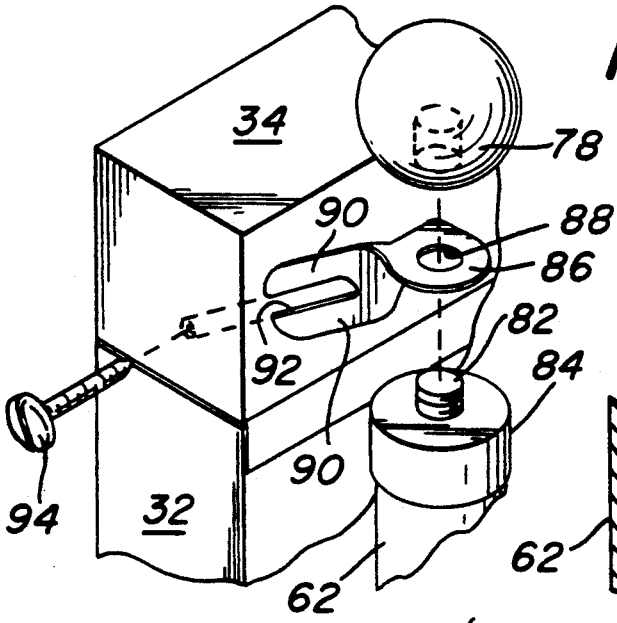
FIG. 10 is an exploded perspective view showing the elements for securing the screen to the frame for the glass panels; and, FIG. 11 is an exploded perspective view showing the arch and frame for the glass panels.

The end screen panels 58 are rigidly mounted in frame 28, and are secured to frame 22. The manner of securement is best seen in FIG. 10. As seen in FIG. 10, the threaded end 82 of a shaft 96 (FIG. 9) mounted within tubular member 62 projects through an opening in cap 84 of the tubular member. A clip 86, having an opening 88, is placed over threaded end 82. The clip is secured in place by decorative ball 78, which is threadedly secured on end 82.

The clip 86 includes a pair of legs 90 separated by slot 92. The legs 90 are placed against the side edge of top member 34 of frame 22, and a screw 94 is passed through slot 92, and is threadedly secured in top member 34. This secures the side panels 58 to the frame 22.

Referring now to FIG. 9, shaft 96, the top of which is threaded, as shown at 82 in FIG. 10, is received in U-shaped channel 52. A shaft 98 is welded to, and projects horizontally from, shaft 96. Shaft 96 is mounted within decorative tubular member 62. A vertical shaft similar to shaft 96 is welded to the other end of shaft 98, and the two vertical shafts are joined by an arcuate shaft, having the same shape as top tubular member 64. Wire screen 76 is secured on the framework formed by the vertical shafts, the horizontal shaft 98 and the arcuate top shaft. The framework is covered by the tubular members. The tubular members are slotted to permit the screen to pass therethrough. However, the tubular members give the screen panels their decorative appearance, such as that shown in FIGS. 1 and 2.

Figure 7:
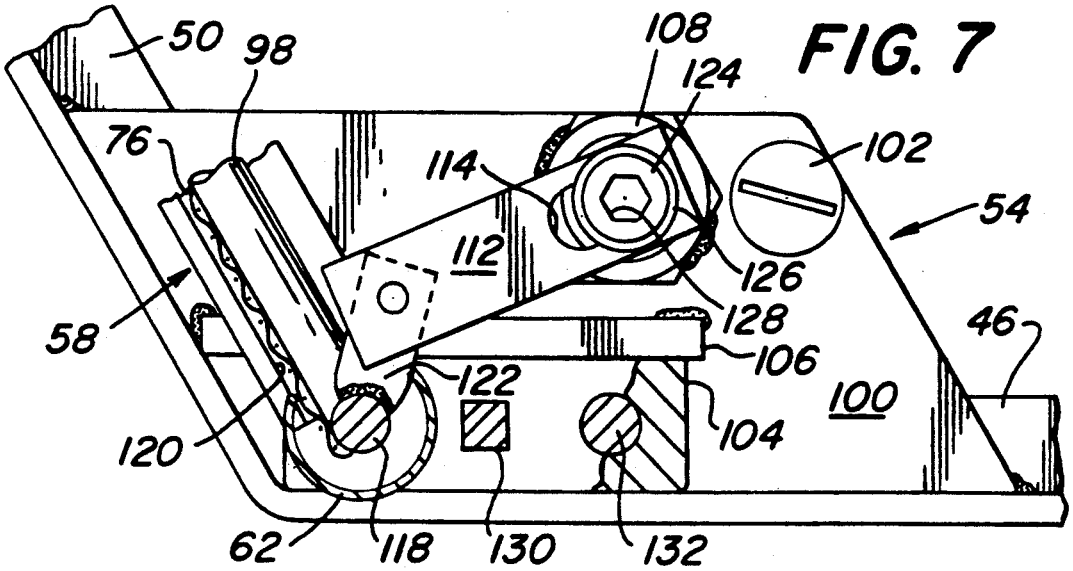
FIG. 7 is an enlarged sectional view taken along the line 7—7 of FIG. 1.
Figure 8:
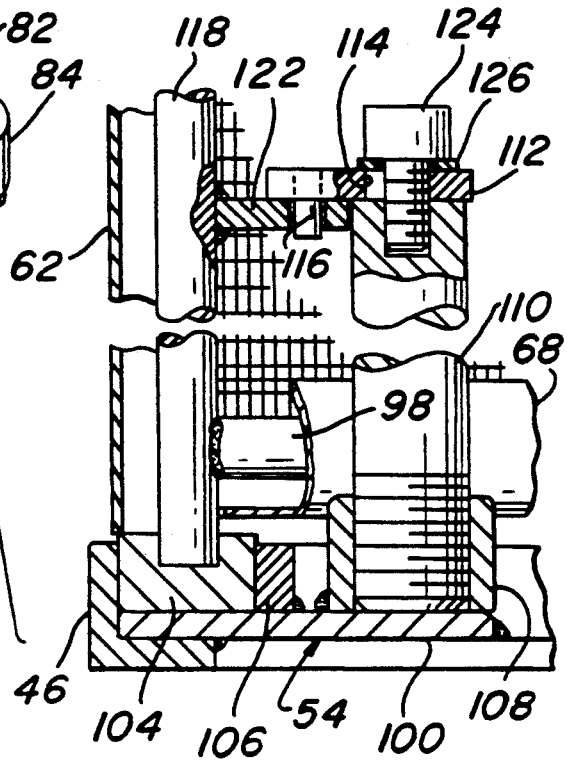
FIG. 8 is an enlarged sectional view taken along the line 8—8 of FIG. 2.

The manner of securing the screen assembly 26 to the frame 28 is best seen in FIGS. 2, 7 and 8. As seen in FIGS. 7 and 8, the mounting assembly 54 comprises a plate 100 that is welded at the intersection of legs 46 and 50. There are a pair of plates, with one being positioned at each intersection. The plates are welded to the top of the horizontal portion of each leg.

A bolt 102 (FIGS. 4 and 7) is threadedly secured in plate 100. The bolt serves the function of leveling the support frame 28 on the hearth. Thus, when the hearth is a stone hearth, its top surface is not smooth, and the bolts 102 compensate for any irregularities in the surface.

A horizontal bar 104 (FIGS. 7 and 8) is mounted on the upper surface of plate 100, and a vertically extending bar 106 is welded on plate 100, and secures horizontal bar 104 in place. A nut 108 (FIGS. 4, 7 and 8) is welded to the top of plate 100.

A rod 110 (see FIG. 2) is threadedly secured in nut 108, and extends vertically upwardly therefrom. A plate 112 (FIGS. 2 and 7) is positioned at the top of rod 110. Plate 112 includes an elongated slot 114 adjacent one end thereof. A pin 116 is mounted in the underside of plate 112, and is positioned adjacent the end opposite slot 114.

A shaft 118 projects vertically upward, and is parallel to shaft 96 (FIG. 9) of screen panel 58. Shaft 228 is welded to shaft 98, and forms the other vertical shaft for forming the frame to hold wire screen 76. The slot in decorative tube 68, through which the screen 76 passes, is shown at 120 in FIG. 7. Similar slots are provided in the other decorative tube members, for the same purpose.

A tab 122 is welded to shaft 118 (FIGS. 7 and 8). As seen in FIG. 8, the bottom of shaft 118 is received in a circular opening formed in plate 104. Tubular member 62 surrounds shaft 118, and is slotted to accommodate the screen 76 and its supporting frame. A slot is also provided in tubular member 62 to accommodate tab 122.

In assembling the enclosure of this invention, the screen assembly 26 is secured to the frame 28 by first inserting the rods 110 in their respective nuts 108, and threadedly securing them in place. The screen assembly 26 is then placed on the frame 28 and the pin of plate 112 is inserted in an opening in tab 122. The plate 112 is placed on the top of rod 110 (FIG. 8) and is threadedly secured in place by bolt 124 and associated washer 126. As seen in FIG. 7, the top of bolt 124 includes a hexagonal recess 128, to receive a wrench for tightening the bolt in place. With the bolt secured in place on the top of each rod 110, the screen assembly is rigidly linked to the frame 28. Through the use of clips 86 (FIG. 10) and associated screws 94, the screen assembly is also rigidly connected to the frame for the glass doors. Accordingly, the frame 28, glass door frame 22 and screen assembly 26 form an integral unit. If the frame 22 is to be mounted within the fireplace opening, the screws 94 are inserted through the clip prior to the mounting of the door frame. Alternatively, if the door frame will be mounted against the front wall adjacent the fireplace opening, then the screws 94 can be inserted after the door frame 22 is secured in place.

As will be described in further detail hereinafter, each pair of adjacent screen panels has a square rod 130 (FIG. 7) positioned therebetween. The rod 130 positioned between a side panel 58 and a center panel 60 is received in an opening in plate 104. A vertical shaft 132 of screen panel 60 is shown in cross section in FIG. 7. Shaft 132 is similar to shaft 96 (FIG. 9) and forms part of the framework for holding the screen in screen panel 60. The screen in each of the panels is held in place by identical framing.

The screen panels 60 are maintained in the position shown in FIGS. 1 and 2 whenever the fire is actively burning or whenever the fireplace is not in use. When access is required to the fireplace, such as for cleaning, igniting the fire or adding wood, the panels 60 are swung outwardly, around their left and right edges, respectively, in the direction of the arrows shown at 134 in FIG. 2. The mechanism for maintaining the screen panels in the position shown in FIGS. 1 and 2, and for permitting the panels to be swung outwardly in the direction of arrows 134, is shown in FIGS. 3, 4, 5 and 6.

The securing mechanism includes aforementioned L-shaped bracket 56 (FIG. 4). The bracket is maintained in place by a bar 136 (FIGS. 4 and 5) that is welded to the vertical portion of front leg 46. A clip 138 is mounted on the vertical portion of L-shaped bracket 56. The clip includes a rear leg 140, a bridging section 142, a front leg 144 and a flange 146. The clip is secured to bracket 56 by rivet 148. The clip is formed from spring steel, and frictionally and resiliently engages the bottom of left screen panel 60, as viewed in FIG. 1, as will be explained with reference to FIG. 5.

Figure 3:
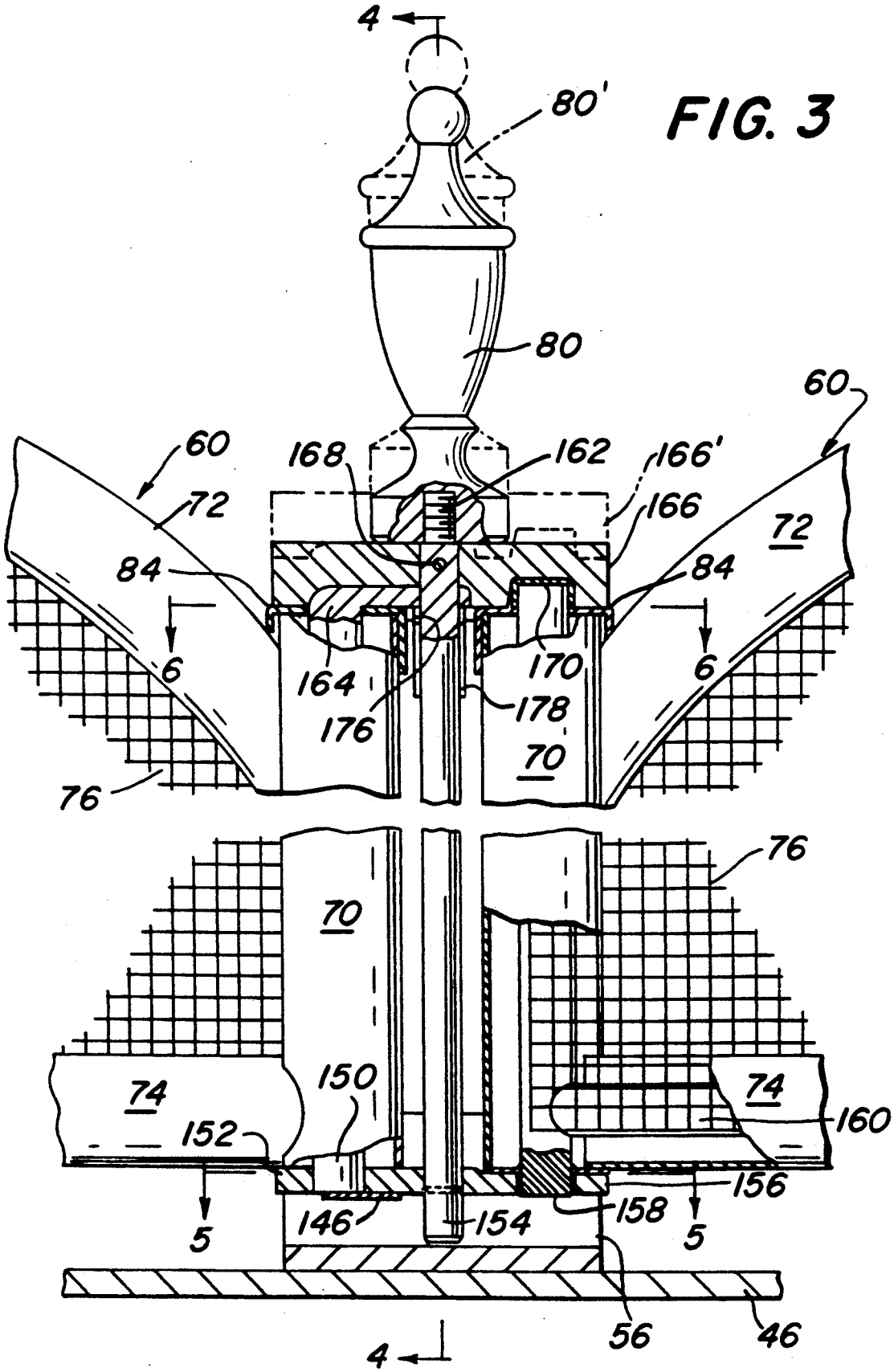
FIG. 3 is a front elevational view, partially broken away and partially in section, showing the latching mechanism of the screen assembly of this invention.
Figure 5:
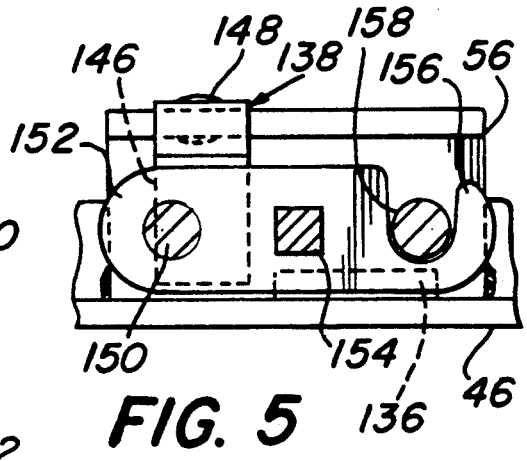
FIG. 5 is a sectional view taken along the line 5—5 of FIG. 3.

Referring to FIGS. 3 and 5, it is seen that left screen panel 60 includes a vertically extending shaft 150. Secured on the bottom of shaft 150, as by welding, is a plate 152. Plate 152 includes an opening through which square rod 154, which is similar to square rod 130 (FIG. 7), passes. The end of plate 152, opposite shaft 150, is notched to form a hook 156.

Referring now to FIG. 3, it is seen that right screen section 60 includes a vertical shaft 158 and a horizontal shaft 160 connected thereto. Shafts 158 and 160 form a part of the frame for securing the wire screen 76 in place, as previously described. The shafts holding the screen in place are covered by the decorative tubular members 70, 72 and 74. Square rod 154 is positioned between screen sections 60, and has a threaded upper end 162. Finial 80 is threadedly secured on square rod 154.

The top of shaft 150 passes through the decorative cap 84 on tubular member 70 and has a flange 164 (FIGS. 3 and 6). Flange 164 has a square opening therein, through which square rod 154 passes.

A cover 166 (see also FIG. 1) is positioned beneath finial 80. Covers having similar outer appearances are positioned beneath the other finials 80. The covers are formed from a decorative metal, such as brass, and are formed from the same metal as the tubular members of the screen panels. Cover 166 is secured to square rod 154 by pin 168. As seen in FIGS. 3 and 4, the cover 166 has a recess in its undersurface to permit it to overlie and receive flange 164. There is a second recess which permits the end cap 170 on shaft 158 to be received within the cover. The end cap is also formed from a decorative metal, which is the same as the cap 84 and the tubular members of the screen panel.

A lock 172 is mounted against the bottom of cover 166 by screw 174. Lock 172 includes a plate 176 and a dependent flange 178. A slot 180 is formed in plate 176, and the lock 172 is movable along the slot. The lock is held in place by the head of screw 174, which is larger than the width of the slot. A pin 182 is secured in square rod 154, and projects outwardly therefrom.

The engagement of the bottom of square rod 154 in the channel formed by bracket 56 and bar 136 is shown in FIG. 4. Any attempt to pivot the screen sections outwardly, in the direction of arrows 134 (FIG. 2) is prevented by the engagement of the rod with bar 136. The rod 154 is movable vertically upward, to lift its bottom above the upper edge of bar 136. The vertical movement of the rod is accomplished by lifting finial 80, which is threadedly secured to the rod. When the finial is lifted, it will also lift cover 166, which is secured to rod 154 by pin 168. However, upward movement is prevented by the engagement of the upper face of plate 176 With flange 164. Thus, left screen panel 60 is immovable vertically and, accordingly, vertical contact with the underside of flange 164 prevents any further upward movement. So long as rod 154 cannot move upwardly, neither panel 60 can be pivoted. Thus, since plate 152 is secured to shaft 150 (FIG. 5), and since the rod 154 passes through the plate, left panel 60 is immovable. Similarly, any attempt to pivot right panel 60 is prevented by the engagement of shaft 158 with hook 156 (FIG. 5).

When it is desired to pivot the screen panels 60 outwardly, flange 178 is pulled to the right, from the position shown in FIG. 4. This permits the plate 176 to move to the right, along slot 80. This frees the lock formed by the abutment of plate 176 against the underside of flange 164. At this point, the finial 80 can be raised, which will raise rod 154 along with it. The upward movement of the rod 154 is stopped by the abutment of pin 182 against the underside of flange 164, as shown in phantom at 182' in FIG. 4. The upward position of finial 80 is indicated at 80' in FIG. 4, and the upward position of cover 166 is indicated at 166'. Similarly, lock 172 is raised along with cover 166, and its retracted and upper position is indicated at 172' in FIG. 4.

With the finial in its raised position, the bottom of rod 154 is at a position that is higher than the upper edge of bar 136. At this point, the left screen panel can be pivoted outwardly, in the direction of arrow 134 to any desired open position. The pivoting takes place around shaft 132 (FIG. 7). In this connection, the lower edge of the screen panels is positioned above the upper edge of leg 46. In the pivoting of the left screen panel 60, the finial 80 and its associated cover 166 and rod 154, move with the left panel.

With the left panel moved out of the way, the hook 156 (FIG. 5) no longer engages the bottom of rod 158 Accordingly, right screen panel 60 is now free to rotate in the direction of arrow 134. The rotation is about a shaft identical to shaft 132, but being placed on the right side of the right panel 60.

The rotation of the left screen panel 60 around its associated shaft 132 will now be described in further detail, it being understood that there is identical structure for the counterpart shaft of right screen 60. The bottom of shaft 132 is rotatable in a socket formed in horizontal bar 104 (FIG. 7). The top of shaft 132 is rotatable in a socket formed in cover 166 under finial 80 (FIG. 1). In this connection, the outer finials 80 are supported on a square rod 130 (FIG. 7), which is secured in bar 104. A cover 166 is placed over the top of the bar and the finial 80 is threadedly secured over the cover, in the nature of the structure shown in FIG. 3. The cover 166 has two sockets, with one socket receiving the top of shaft 118 and the other socket receiving the top of shaft 132 (FIG. 7). Accordingly, screen panels 58 and 60 are rotatable relative to the square rod 130, which is rigidly fixed in place. Having the panels 58 rotatable relative to panels 60 permits the folding of the panels 58 onto panels 60, for shipment and storage. When the enclosure is assembled, the panels 58 are no longer rotatable, since they are held in place relative to the frame 28 by the securement of the clips 86 to frame 22 (FIG. 10).

When the panels 60 are pivoted outwardly, access can be gained to the fireplace, after the glass panels are pivoted to the position shown at 24' in FIG. 2. When it is no longer necessary to have access to the fireplace, the screen panels 60 are rotated back to the positions shown in FIGS. 1 and 2. In rotating the panels back to their closed positions, the right hand panel 60 is first rotated in a direction opposite the direction of arrow 134 in FIG. 2, to a position just prior to contacting the vertical leg of bracket 56 (FIGS. 4 and 5). Thereafter, the left panel 60 is rotated in a direction opposite that shown by arrow 134, until its bottom plate 152 abuts the vertical leg 144 of clip 138 (FIG. 4). Since the clip is formed from a spring metal, the flange 146 frictionally and resiliently engages plate 152, and holds it in place. At the same time, the hooked end 156 of plate 152 engages shaft 158, and holds it in place. Accordingly, the right screen panel 60 is no longer rotatable outwardly, since rotation is prevented by the hook 156.

With the screen panels 60 in place, the finials 80 are pushed downwardly, thereby having the right recess in the underside of cover 166 engage the top of shaft 158 (FIG. 3). Thereafter, the lock 172 is moved inwardly, to the position shown in full line in FIG. 4, and this prevents the raising of the finial and its associated rod 154. This securely locks the screen panels in a closed position.

Although the enclosure of this invention has been described as being used with, and secured to, a glass fireplace door, it is to be understood that the invention can be used without having the glass door, or without being secured to the glass door. In this connection, if it is desired to have a rigidly secured fireplace screen, rather than having one which must be lifted and folded for placement away from the fireplace, when access to the fireplace is needed, this can be accomplished by utilizing the frame 28 and the screen panels. When used in this manner, the screen panels 58 can be secured to the wall surrounding the fireplace opening or the wall within the fireplace opening, through the use of the clips 86 and screws 94, which are screwed into the wall, rather than the frame for the glass panels. Alternatively, the outermost ends of the panels 58 can be secured to rods similar to rods 110, using a connection similar to that obtained by tabs 122, to obtain a rigid securement.

One of the advantages of the enclosure of this invention is the fact that the screen panels are held rigidly in place, which prevents any access to the fire by a child. In the prior art, where glass doors are used, and are open when there is an active fire, the screen which is used to prevent sparks from flying into the room is in the nature of a drape or curtain positioned behind the frame for the glass panels. A young child could inadvertently fall into the fire if he tripped while playing near the fireplace. The rigid screen structure of this invention prevents that from happening. The screen panels are held rigidly in place, and cannot be knocked over by a child's falling into them. Since the lock 172 is placed on the rear side of the panels, a person would have to be relatively tall to be able to reach over and gain access to the lock, and thereafter open it. A young child would not have sufficient height or dexterity to accomplish this and, accordingly, the enclosure of this invention provides a far safer structure than was previously available.

Without further elaboration, the foregoing will so fully illustrate this invention that others may, by applying current or future knowledge, readily adapt the same for use under various conditions of service.

I claim:

1. A fireplace enclosure comprising a frame adapted to be mounted on the hearth in front of a fireplace, said frame comprising a front leg and side legs projecting from said front leg, all of said legs lying in a horizontal plane, said legs being adapted to rest on said hearth, a screen assembly adapted to be secured to said frame, said screen assembly comprising a plurality of screen panels, with at least one of said screen panels being pivotable relative to another of said screen panels, and means for securing said screen assembly to said frame.

2. The fireplace enclosure of claim 1 wherein said securing means comprises at least one rod secured to said frame and projecting vertically upward therefrom, and means for connecting said rod to said screen assembly.

3. The fireplace enclosure of claim 2 wherein said connecting means comprises a plate that is releasably secured to said rod and a tab secured to said screen assembly, with said tab being linked to said plate.

4. The fireplace enclosure of claim 1 wherein said screen assembly comprises a pair of side panels and at least one central panel, with said central panel being pivotable relative to one of said side panels.

5. The fireplace enclosure of claim 4, and further including locking means for maintaining said central panel in a fixed position relative to said side panel, whereby it cannot be pivoted relative to said side panel until said locking means is released.

6. The fireplace enclosure of claim 4 wherein said screen assembly comprises a pair of central panels, with each of said central panels being pivotable with respect to an adjacent side panel, and means for locking said central panels to prevent pivoting relative to said side panels.

7. The fireplace enclosure of claim 6 wherein said locking means comprises a rod, said rod being received within channel means on said frame, said central panels being pivotable when said rod is lifted out of said channel means, and means to prevent said rod from being lifted out of said channel means, thereby locking said rod in place.

8. The fireplace enclosure of claim 7 wherein said one of said central panels includes a shaft forming one side of a screen frame, said shaft being positioned adjacent an outer shaft on the other of said central panels when said rod is in its locked position, said first-mentioned shaft having a flange, said rod passing through an opening in said flange, cover means overlying the tops of said shafts, said cover means being secured to said rod, and said locking means being carried by said cover means.

9. The fireplace enclosure of claim 8 wherein said locking means comprises a plate slidably mounted on the underside of said cover means, said plate being adapted to engage the underside of said flange, when said rod is in its locked position, and said plate being adapted to bypass said flange when said rod is in its unlocked position.

10. The fireplace enclosure of claim 8, and further including a plate secured on the bottom of said first-mentioned shaft, said plate extending in the direction of said second mentioned shaft, said plate having a hook formed at one end thereof, and said hook engaging said second-mentioned shaft when said rod is in its locked position.

11. The fireplace enclosure of claim 10 wherein said rod passes through said plate.

12. The fireplace enclosure of claim 4, and further including means on said side panels for securing said side panels at the fireplace opening.

13. The fireplace enclosure of claim 12 wherein said securing means comprises a clip mounted on each of said side panels.

14. A fireplace enclosure comprising a frame adapted to be mounted on the hearth in front of a fireplace, a screen assembly adapted to be secured to said frame, said screen assembly comprising a plurality of screen panels, with at least one of said screen panels being pivotable relative to another of said screen panels, means for securing said screen assembly to said frame, a plurality of glass panels, said glass panels being mounted within a panel frame, said panel frame being adapted to be mounted on said first-mentioned frame, and means for securing said screen assembly to said panel frame.

15. The fireplace enclosure of claim 14 wherein said panel frame is adapted to be mounted at the opening to said fireplace, with the screen assembly being mounted exteriorly of the panel frame.

16. The fireplace enclosure of claim 15 wherein said glass panels are pivotable relative to said panel frame, whereby access may be obtained to the fireplace.

17. The fireplace enclosure of claim 14, and further including a metal arch, said metal arch being releasably secured to said panel frame.

18. The fireplace enclosure of claim 17 wherein said metal arch is secured to said panel frame on the interior thereof, and is visible through said glass panels.

19. The fireplace enclosure of claim 17 wherein said metal arch is secured to said panel frame by spring clips.

20. A fireplace enclosure comprising a frame, said frame including a top, said frame being adapted to be secured at a fireplace opening, a plurality of glass panels mounted within said frame, said glass panels being pivotable from a position wherein they are aligned to seal the fireplace opening to a second position wherein access can be gained to the fireplace opening, and a metal arch projecting downwardly from said top, and means for releasably securing said arch to said frame.

21. The fireplace enclosure of claim 20 wherein said metal arch is secured to said frame interiorly of said glass panels 22. The fireplace enclosure of claim 20 wherein said metal arch is secured to said frame by spring clips.

* * * * *